United States Patent [19]

Miyaoka

[11] Patent Number: 4,805,394

[45] **Date of Patent: * Feb. 21, 1989**

[54] METHOD AND APPARATUS FOR FALSE TWISTING

[75] Inventor: Mitsuhiko Miyaoka, Kyoto, Japan

[73] Assignee: Murata Kikai Kabushiki Kaisha, Kyoto, Japan

[ * ] Notice: The portion of the term of this patent subsequent to Nov. 21, 2002 has been disclaimed.

[21] Appl. No.: 205,959

[22] PCT Filed: Dec. 22, 1979

[86] PCT No.: PCT/JP79/00321

§ 371 Date: Aug. 25, 1980

§ 102(e) Date: Aug. 25, 1980

[87] PCT Pub. No.: WO80/01288

PCT Pub. Date: Jun. 26, 1980

[30] Foreign Application Priority Data

Dec. 25, 1978 [JP] Japan ..... 53-165008

[51] Int. Cl.[4] ..... D02G 1/02; D01H 15/00

[52] U.S. Cl. ..... 57/280; 57/336

[58] Field of Search ..... 57/279, 280, 334–337

[56] References Cited

U.S. PATENT DOCUMENTS 3,701,245 10/1972 Richter ..... 57/280 X
3,733,801 5/1973 Jones ..... 57/280
3,842,578 10/1974 Schippers ..... 57/280
3,886,722 6/1975 Hori et al. ..... 57/280 X
3,971,201 7/1976 Hartig ..... 57/280
4,047,373 9/1977 Takai ..... 57/336
4,149,366 4/1979 Bass et al. ..... 57/280

*Primary Examiner*—John Petrakes
*Attorney, Agent, or Firm*—Barnes, Kisselle, Raisch, Choate, Whittemore & Hulbert

[57] ABSTRACT

Method and apparatus for false twisting a yarn. The apparatus includes false twisting endless belts arranged to intersect each other at a nip point, a pivotally mounted arm having a yarn guide on one end thereof, a pivotally mounted bracket and adjustable cam means for maintaining the arm in separate adjusted positions wherein yarn guided by the yarn guide passes directly through the nip point of the endless belts to provide a predetermined number of false twists to the yarn and wherein the yarn is preliminarily false twisted with a twist number less than the predetermined twist number during initiation of false twisting. The method of the invention includes the steps moving the arm into a position wherein the yarn is engaged with the false twisting endless belts but not at the nip point or intersection thereof to impart initial or preliminary false twisting to the yarn and subsequently positioning the arm so that yarn guided thereby is passed through the nip point between the false twisting endless belts.

12 Claims, 1 Drawing Sheet

METHOD AND APPARATUS FOR FALSE TWISTING

TECHNICAL FIELD

The present invention relates to a false twisting method and false twisting apparatus. More particularly, the present invention relates to a false twisting method in which a false twist threading device capable of preliminarily false-twisting the yarn is used before a yarn is nipped and false-twisted between two running endless belts of a false twisting device and also relates to a false twisting apparatus for carrying out this false twisting method.

BACKGROUND ART

In a false twisting apparatus for imparting false twists to yarns, yarn breakage is readily caused when the yarn is started to be false-twisted. The finer is the yarn to be treated, the more readily is caused yarn breakage. This yarn breakage is caused also in a false twisting apparatus of the type where a yarn is nipped and false-twisted between two false twisting belts running in directions opposite to each other. In this false twisting apparatus, when travel of the yarn which has been kept in the stationary state is started, the friction is highest at the contact point between the yarn and a mechanical element of the false twisting apparatus. Accordingly, in order to prevent yarn breakage, it is preferred that the yarn is kept to be separated from between the false twisting belts on starting the travel of the yarn.

After travel of the yarn has been started, the friction between the yarn and mechanical element can be reduced if the yarn is slightly false-twisted preliminarily (hereinafter referred to as "semi-twisting"), as compared with the case where the yarn is not preliminarily twisted at all.

A false twisting apparatus is ordinarily laid out so that a yarn taken out from a yarn supply bobbin by a pair of feed rollers is introduced to a winding device through a heater, a cooling device, a false twisting device and a delivery device. As pointed out hereinabove, it is preferred that when travel of the yarn is started, the yarn be slightly false-twisted, that is, semi-twisted, and that the operation of closing a rotating feed roller and the contact of the yarn with a heating plate, a cooling plate or a ballon-controlling plate be carried out in this state.

DISCLOSURE OF INVENTION

According to the method of the present invention, when a yarn is nipped at the nip point of a false twisting device including two running endless belts which are kept in intersecting contact with each other and is false-twisted in this nipped state, the yarn is preliminarily false-twisted (semi-twisted) with a twist number less than the number of twists to be imparted at the nip point and the yarn is then false-twisted at the nip point with a predetermined twist number.

By imparting the above-mentioned semi-twists to the yarn at the start of travel of the yarn, the strength of the yarn can be increased, occurrence of yarn breakage at the start of travel of the yarn can be prevented and the friction of the yarn with mechanical elements can be reduced.

In the false twisting apparatus of the present invention, a false twisting threading device for introducing a yarn to the nip point of a false twisting device including two running false twisting endless belts which are kept in intersecting contact with each other is disposed in close proximity to the false twisting device. In the false twisting threading device, the yarn to be twisted is introduced to or separated from the nip point of the false twisting device by a yarn guide of this false twisting threading device. When travel of the yarn is started, the yarn is brought into contact with the false twisting belts at the point outside the nip point to impart semi-twists to the yarn and then, the yarn is introduced to the nip point to impart a predetermined number of false twists to the yarn or the yarn is not brought in contact with the false twisting belts at all.

BEST MODE FOR CARRYING OUT THE INVENTION

Figure 1:
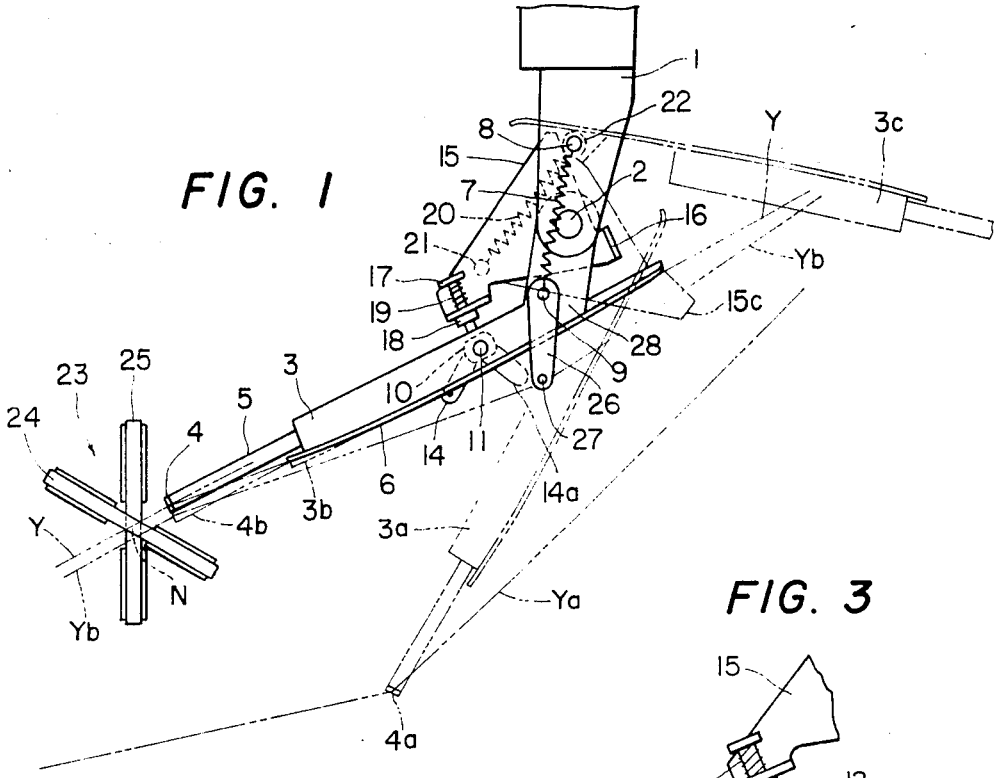
FIG. 1 is a front view of the apparatus according to the present invention.
Figure 3:
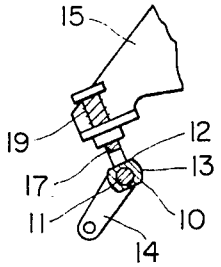
FIGS. 3 and 4 are diagrams illustrating operations of a cam and an adjust bolt.
Figure 2:
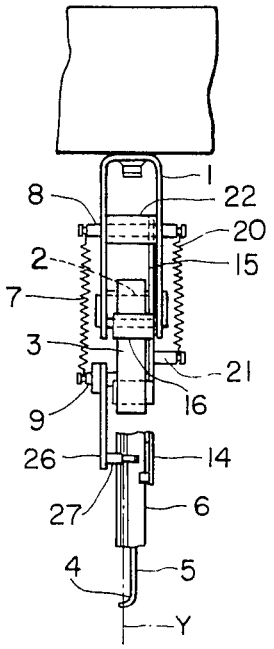
FIG. 2 is a partially cut-out side view of the apparatus shown in FIG. 1.
Figure 4:
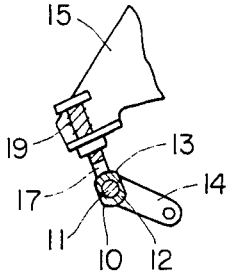

FIG. 1 is a front view of the apparatus of the present invention. An arm (3) is turnably supported on a fulcrum shaft (2) mounted on a stationary bracket (1), and an arm (5) having a yarn guide (4) supported on the top end thereof is secured to the arm (3). Reference numeral (6) represents a balloon controlling plate secured to the arm (3). A spring (7) is spread between a pin (8) fixed to the bracket (1) and a pin (9) projected from the arm (3). When the arm (3) is located at the position indicated by a solid line in FIG. 1, the spring (7) is located on the left side of the fulcrum shaft (2) to urge the arm in the clockwise direction. When the arm (3) is turned and is located at the position indicated by a chain line (**3*a*), the spring (7) exceeds the maximum extension position and is located on the right side of the fulcrum shaft (2) to urge the arm (3) in the counterclockwise direction. A cam (10) is rotatably supported on the arm (3) by a shaft (11), and as shown in FIGS. 3 and 4, the cam (10) includes a smooth portion (12) and an arcuate portion (13). An operation lever (14) for rotating the cam (10) is secured integrally with the cam (10**).

A bracket (15) is turnably supported on the stationary bracket (1) by the fulcrum shaft (2), and a stopper piece (16) is formed integrally with the bracket (15), so that it projects into the turning locus of the arm (3). An adjust bolt (17) is screwed into a nut (18) secured to the bracket (15), and a spring (19) is disposed to prevent natural rotation of the adjust bolt (17). A spring (20) is spread between the above-mentioned pin (8) and a pin (21) projected from the bracket (15). The spring (20) is normally located on the left side of the fulcrum shaft (2) to urge the bracket (15) in the clockwise direction, whereby a part of the bracket (15) is brought into butting contact with a stopper pipe (22) fitted and inserted over the pin (8) and the bracket (15) is secured in this state.

A false twisting device (23) includes two running false twisting endless belts (24) and (25) which are kept in intersecting contact with each other, and the intersecting point is used as the nip point (N). A piece (26) of a yarn guide (27) is supported on the pin (9) so that it can freely be turned by a manual operation or the like.

The process of the present invention will now be described.

In the normal yarn processing operation, a yarn taken out of a yarn feed bobbin passes through a first feed roller, a preheater, a cooling plate and a cooling device and runs on the balloon controlling plate (6) while having contact with the balloon controlling plate (6) as indicated by (Y) in FIG. 1. Then, the yarn passes through the nip point (N) where the belts (24) and (25) of the false twisting device (23) are kept in contact with each other, and the yarn is false-twisted at the nip point (N). Then, the yarn passes through a delivery roller and also through a second heater and a secondary delivery roller in some case, and the yarn is wound by a winding device.

In accordance with the present invention to start the yarn processing operation, an end face (28) of the arm (3) is butted against the stopper piece (16) of the bracket (15) to turn the bracket (15) in the counterclockwise direction, and the arm (3) is kept secured at the position (3*a*) shown in FIG. 1, and all of the feed rollers and delivery rollers (not shown) are opened and the yarn is hung on the yarn guide (4) at the position (4*a*) shown in FIG. 1 in the state where the yarn is separated from the preheater and cooling plate. At this point, the yarn is separated from the balloon controlling plate (6) and the false twisting device (23). In this state, the rotating delivery roller is closed and travel of the yarn is started.

Then, the lever (14) is located at the position (14*a*) shown in FIG. 1, that is, at the position shown in FIG. 4, and the arm (3) is turned from the position (3*a*) in the clockwise direction. By the clockwise urging force of the spring (7), which is caused when the spring (7) passes through the maximum extension position, the arcuate portion (13) of the cam (10) is brought into butting contact with the adjust bolt (17) to fix the arm (3) at the position (3*b*) shown in FIG. 1. At this point, the yarn guide (4) is located at the position (4*b*) to guide the yarn to the outside of the nip point (N) of the false twisting belts (24) and (25), and the yarn is not nipped by the false twisting belts (24) and (25) but is brought into contact with the false twisting belts (24) and (25) and is semi-twisted. At this point, the yarn (Y) is bent and guided by the yarn guide (27) projected from the piece (26) secured to the pin (9) as indicated by (Yb), so that the yarn is prevented from having contact with the balloon controlling plate (6).

While the yarn is in the above-mentioned semi-twisted state, the rotating feed roller and the second delivery roller are closed, and the yarn is introduced into the preheater, brought into contact with the cooling plate and introduced into the cooling device. Then, the yarn is taken out from the yarn guide (27) by a manual operation or the like and brought into contact with the balloon controlling plate (6), and the lever (14) is turned to the position indicated by a solid line shown in FIG. 1 and kept in the state shown in FIG. 3 by a manual operation or the like and the smooth portion (12) of the cam (10) is butted against the adjust bolt (17), whereby the arm (3) and yarn guide (4) are moved to the positions indicated by solid lines in FIG. 1 by the elastic force of the spring (7) and the yarn is introduced to the contact portion of the false twisting belts (24) and (25), that is, the center of the nip point (N), and a predetermined number of full false twists are given to the yarn.

Then, the yarn is guided to the winding device and a normally processed yarn is obtained.

In FIG. 1, when the arm (3) is further turned from the position (3*a*) in the counterclockwise direction, the bracket (15) is turned together with the arm (3) and the spring (20) is shifted to the right side of the fulcrum shaft (2), whereby the bracket (15) is urged in the counterclockwise direction by the spring (20) and the arm (3) is fixed at the position (3*c*) in the state (15*c*) where a part of the bracket (15) is butted against the stopper pipe (22). In this state, repair, inspection and maintenance of the device (23) can be carried out.

INDUSTRIAL APPLICABILITY

According to the method and apparatus of the present invention, when the yarn is fed to the false twisting devices in the process for preparing a processed yarn, the yarn may optionally be guided by a simple operation to any of the following three positions, the position where the yarn is separated from the nip point of the false twisting devices but is semi-twisted while being contacted with the belts, the position where the yarn is fully false-twisted within the nip point and the position where the yarn is completely separated from the belts. By virtue of this featrue, various advantages can be attained.

I claim:

1. A false twisting apparatus comprising two running false twisting endless belts intersecting to define a nip point therebetween, a stationary bracket, a fulcrum shaft on said stationary bracket, a false twist threading device including an arm having a yarn guide on the top end thereof and a turning locus at the other end thereof, a pivoted bracket which has an adjust bolt on one end and a stopper piece located within the turning locus of the arm on the other end thereof and which is turnably supported by said fulcrum shaft mounted on said stationary bracket, a first spring having opposite ends secured to the stationary bracket and arm, said first spring being arranged so that when the arm is turned beyond the maximum extension position of the first spring, the direction of the urging force to the arm applied by the first spring is reversed, a cam rotatably supported on the arm in contact with the adjust bolt, and a second spring having opposite ends secured to the stationary bracket and pivoted bracket, said second spring being arranged so that when the pivoted bracket is turned beyond the maximum extension position of the spring, the direction of the urging force to the pivoted bracket applied by the second spring is reversed, wherein said false twist threading device is disposed so that the yarn guide of said false twist threading device is brought into close proximity to the nip point between the two running false twisting endless belts.

2. False twisting apparatus comprising two intersecting false twisting endless belts defining a nip point therebetween, means for driving said endless belts and a false twist threading device positioned adjacent the false twisting endless belts for guiding yarn to the false twisting endless belts including an arm having a yarn guide on one end thereof, means pivotally mounting the arm at the other end thereof and means engageable with the arm for selectively maintaining the arm in a position to guide the yarn between the belts in spaced relation to the nip point therebetween to impart a preliminary false twist to the yarn during initiation of false twisting of the yarn to prevent breakage thereto and for subsequently positioning the arm to guide the yarn into the nip point between the false twisting endless belts.

3. Structure as set forth in claim 2, and further including means for initially positioning the arm in a position for threading the yarn on the arm wherein the yarn is guided in spaced relation to the false twisting endless belts .

4. Structure as set forth in claim 3, wherein the arm includes a balloon controlling plate and further including means secured to the arm for maintaining the yarn in spaced relation to the balloon controlling plate during preliminary false twisting of the yarn.

5. Structure as set forth in claim 2, and further including means for positioning the arm away from the false twisting endless belts and maintaining it in spaced relation thereto to permit inspection and maintanence thereof.

6. A false twist threading device comprising two intersecting false twisting endless belts, a stationary bracket, an arm including a balloon controlling plate thereon pivotally mounted on the fixed bracket at one end thereof and including a yarn guide on the other end thereof for guiding yarn between the intersection of said two false twisting endless belts, means for limiting pivotal movement of the arm in one direction to accurately direct yarn from the arm between the false twisting endless belts and means biasing the arm into engagement with the means for limiting the pivotal movement of the arm in the one direction, the means limiting the pivoting of the arm in the one direction including a pivotally mounted bracket having an adjustable abutment thereon mounted for pivotal movement about the one end of the arm and an abutment screw engageable with the bracket to limit pivotal movement of the pivotally mounted bracket in the one direction, and an adjustable cam on the arm engageable with the abutment screw in selected positions of the cam to provide two limiting positions for the arm wherein yarn is guided from the arm between the false twisting endless belts at the nip point therebetween, whereby false twisting is effected in the yarn and in spaced relation to the nip point to provide preliminary false twisting to the yarn.

7. Structure as set forth in claim 6, and further incuding a yarn guide pivotally secured to the arm and selectively positionable to allow the yarn to move over the surface of the balloon controlling plate or to be in spaced relation to the plate.

8. Structure as set forth in claim 7, and further including a spring operable between the stationary bracket and pivoted bracket for biasing the pivoted bracket in limiting positions in two different directions about the pivot mounting of the arm in accordance with the position of the pivoted bracket.

9. Structure as set forth in claim 8, wherein the means biasing the arm into engagement with the means for the pivotal movement of the arm in the limiting one direction is a second spring connected between the fixed bracket and arm so as to bias the arm in opposite directions about the pivot connection of the arm in accordance with the position of the arm to maintain the arm in a yarn threading position wherein it abuts the bracket and in a preliminary twisting position or false twisting position depending on the position of the cam.

10. A false twisting method comprising initially guiding yarn to be false twisted between false twisting endless belts at a point in spaced relation to the nip point at the center of the intersection thereof to impart preliminary false twisting to the yarn and subsequently guiding the yarn between the false twisting endless belts at the nip point to impart a predetermined number of false twists to the yarn.

11. The method as set forth in claim 10, and further including initially threading the yarn on a false twist threading device at a point in spaced relation to the false twisting endless belts.

12. The method as set forth in claim 11 and further including the step of holding yarn in spaced relation to a balloon controlling plate during preliminary false twisting.

* * * * *